US008783193B2

(12) United States Patent
Scharing

(10) Patent No.: US 8,783,193 B2
(45) Date of Patent: Jul. 22, 2014

(54) OPERATOR DESK HAVING SYNCHRONIZED DISPLAYS

(71) Applicant: Pierre Scharing, Boras (SE)

(72) Inventor: Pierre Scharing, Boras (SE)

(73) Assignee: ABB AB (SE)

( * ) Notice: Subject to any disclaimer, the term of this patent is extended or adjusted under 35 U.S.C. 154(b) by 0 days.

(21) Appl. No.: 13/889,993

(22) Filed: May 8, 2013

(65) Prior Publication Data

US 2013/0255544 A1 Oct. 3, 2013

Related U.S. Application Data

(63) Continuation of application No. PCT/SE2008/051293, filed on Nov. 12, 2008.

(30) Foreign Application Priority Data

Nov. 14, 2007 (SE) ..... 0702519

(51) Int. Cl.
*A47B 37/00* (2006.01)

(52) U.S. Cl.
USPC ..... 108/50.01; 108/50.02; 108/102; 312/223.3

(58) Field of Classification Search
USPC ..... 312/223.3, 208.1, 194, 195, 196; 108/50.01, 13, 17, 20, 50.02, 59, 64, 108/65, 69, 70, 71, 102, 106, 137, 144.11, 108/147.19, 92, 96; 248/122.1, 125.2, 121
See application file for complete search history.

(56) References Cited

U.S. PATENT DOCUMENTS

| | | | | |
|---|---|---|---|---|
| 4,725,106 | A * | 2/1988 | Shields et al. | 312/223.3 |
| 4,920,458 | A | 4/1990 | Jones | |
| 5,224,429 | A * | 7/1993 | Borgman et al. | 108/147 |
| 5,443,017 | A * | 8/1995 | Wacker et al. | 108/3 |
| 5,537,127 | A | 7/1996 | Jingu | |
| 5,865,125 | A * | 2/1999 | Alexander et al. | 108/50.11 |
| 6,064,373 | A * | 5/2000 | Ditzik | 345/173 |
| 6,343,006 | B1 * | 1/2002 | Moscovitch et al. | 361/679.04 |
| 6,449,143 | B2 * | 9/2002 | Rooyakkers et al. | 361/679.04 |
| 6,554,238 | B1 * | 4/2003 | Hibberd | 248/278.1 |
| 6,986,556 | B2 * | 1/2006 | Haberman | 312/223.3 |
| 7,878,476 | B2 * | 2/2011 | Carson et al. | 248/429 |

(Continued)

FOREIGN PATENT DOCUMENTS

| | | | |
|---|---|---|---|
| DE | 202006000784 | U1 | 5/2007 |
| EP | 0643935 | A1 | 3/1995 |
| JP | 2003280558 | A | 10/2003 |
| WO | 0021408 | A1 | 4/2000 |

OTHER PUBLICATIONS

International Search Report and Written Opinion of the International Searching Authority Application No. PCT/SE2008/051293 Completed: Mar. 19, 2009; Mailing Date: Mar. 23, 2009 14 pages.

*Primary Examiner* — Daniel Rohrhoff
(74) *Attorney, Agent, or Firm* — St. Onge Steward Johnston & Reens LLC

(57) ABSTRACT

An operator desk system including an operator desk, two display/monitor stands arranged on an operator desk in order to carry one display/monitor each, wherein each display stand includes individual motorized inclining means the inclining means being arranged to change the inclination of the corresponding display stand in a synchronized motion in relation to each other, independent of the location of the displays on the operator desk.

21 Claims, 6 Drawing Sheets

(56) References Cited

U.S. PATENT DOCUMENTS

| | | | | |
|---|---|---|---|---|
| 8,051,782 | B2 * | 11/2011 | Nethken et al. | 108/50.01 |
| 8,596,599 | B1 * | 12/2013 | Carson et al. | 248/429 |
| 2005/0088814 | A1 * | 4/2005 | Jobs et al. | 361/683 |
| 2007/0068429 | A1 | 3/2007 | Frazier | |
| 2007/0170826 | A1 * | 7/2007 | Tsao | 312/223.3 |
| 2008/0289545 | A1 * | 11/2008 | Picchio | 108/106 |
| 2008/0290768 | A1 * | 11/2008 | Haberman | 312/223.3 |
| 2011/0303805 | A1 * | 12/2011 | Lau et al. | 248/125.8 |

* cited by examiner

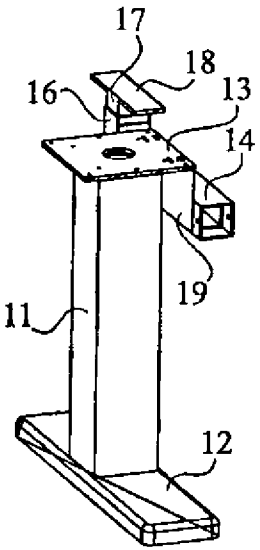
Fig. 2
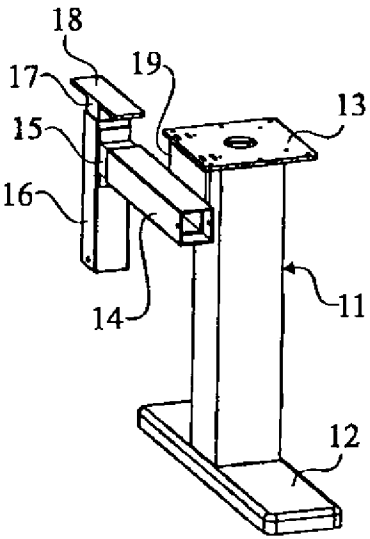

OPERATOR DESK HAVING SYNCHRONIZED DISPLAYS

FIELD OF THE INVENTION

The present invention relates to an operator desk system comprising: an operator desk; at least two display/monitor stands arranged on the operator desk to carry one display/monitor each.

The present invention also relates to a motorized operator desk, particularly a motorized operator desk comprising:

- a front work shelf intended as work surface for one or more operators, said work shelf having an oblong extension with a front long side and a rear long side;
- a rear support structure intended to carry at least one display, said rear support structure being arranged behind the work shelf so that an operator being at the front long side of the work shelf has the work shelf between himself and the support structure; and
- a pedestal carrying the work shelf and the support structure from a ground such as a floor.

BACKGROUND OF THE INVENTION

A good work place for an operator is the prerequisite for creating both efficiency and comfort. During the latest decade computer working places with many displays have been more and more common. The new technique facilitates the supervision and the control of different types of processes, e.g. control rooms, operation and headquarters.

As different people take turns in working at the same workplace, there is a higher demand for flexibility as to adjustments of the operator desks often used for such work as supervision and control.

Today, the applicant markets an operator desk system under the trade name Cergo. This system comprises a front work shelf and a rear shelf intended for displays/monitors, below called display shelf. One or more operators stand or sit in front of the work shelf, and the rear display shelf carries a number of displays. The work shelf and the display shelf may be raised and lowered in relation to the floor and also in relation to each other.

There are also motorized inclination solutions for the displays based on a bar inclinating all displays simultaneously. This functions only on straight table models. Unfortunately, this method offers quite warped angles if one tries to make it on a curved shape of the operator desk, which is the shape mostly sold.

SUMMARY OF THE INVENTION

An object of the invention is to provide an operator desk system which makes more independent locations of the displays possible, i.e. so that they need not be arranged on a straight line.

This object may be achieved by an operator desk system, wherein each display stand comprises individual, motorized inclining means, which inclining means are arranged to change the inclination of the corresponding display stand in a synchronized motion in relation to each other, independent of the locations of said displays on the operator desk. This allows the displays to be optionally placed at the same time as their inclination may be changed in a synchronized motion.

Other characterizing features of the operator desk system are:

- that the operator desk system comprises synchronizing means in order to synchronize the inclining means so that they may change the inclination of the displays in a synchronized motion;
- that the inclining means comprises a fourth motorized actuator arranged to influence the inclination of an articulated rocker, on which the display is mounted;
- that the number of display stands and displays are at least three, preferably at least four, and that they are arranged along a concave line so that the displays face a central point.

Preferably, the operator desk system comprises the operator desk described below.

Therefore, another object of the invention is to provide an operator desk giving improved flexibility in at least some visual angle.

This object may be achieved with an operator desk, wherein the pedestal comprises motorized horizontally adjusting means to adjust the position of the support structure horizontally, in a direction towards and away from the work shelf. This allows the distance to the display to be changed and adapted to an optimal, individual adjustment.

Other characterizing features of the operator desk system are:

- that the pedestal comprises motorized first vertically adjusting means to adjust the height vertically of at least the front table shelf;
- that the first vertically adjusting means include at least one telescopically extendable vertical pillar carrying the work shelf, and at least one corresponding first motorized actuator arranged to change the length of the pillar, preferably the first vertically adjusting means comprise two telescopically extendable vertical pillars arranged at a predetermined distance from each other and at a predetermined distance from one short side each of the work shelf, each one with a first motorized actuator;
- that the horizontally adjusting means of the pedestal comprise at least one from the work shelf telescopically extendable horizontal arm, which extends transversally out from the rear long side of the work shelf, and at least one corresponding second motorized actuator arranged to change the length of the horizontal arm, so that the support structure may adjust its position horizontally in a direction towards and away from the work shelf;
- that the pedestal comprises motorized second vertically adjusting means to adjust the height of the support structure in relation to the work shelf;
- that the second vertically adjusting means for adjustment of the height of the support structure in relation to the work shelf comprises at least one telescopically extendable vertical arm arranged to adjust the height of the support structure, which vertical arm is fixed to a rear end of the horizontal arm, and at least one corresponding third motorized actuator arranged to change the length of the vertical arm;
- that the support structure includes at least two display stands with at least two corresponding displays, each display stand comprising motorized inclining means to adjust the inclination of the corresponding display;
- that the inclining means comprises a fourth motorized actuator arranged to influence the inclination of an articulated rocker, on which the display is mounted;

that the number of display stands and displays are at least three, preferably at least four, and that they are arranged along a concave line so that the displays face a central point;

that the support structure includes a rear flat display shelf;

that the work shelf has an oblong curved shape, wherein the front long side of the work shelf is concave and the rear long side of the work shelf is convex, and that the display shelf also has an oblong curved shape, wherein its concave long side meets the convex rear long side of the work shelf;

that the operator desk comprises a control system including at least one control unit to control the motorized means with the operator desk and a control unit to give input to the control unit.

BRIEF DESCRIPTION OF THE DRAWINGS

Below, the invention will be described more in detail with reference to preferred embodiments and to the enclosed drawings.

FIG. 2 shows a pedestal carrying the operator desk;

DETAILED DESCRIPTION OF THE INVENTION

Figure 1:
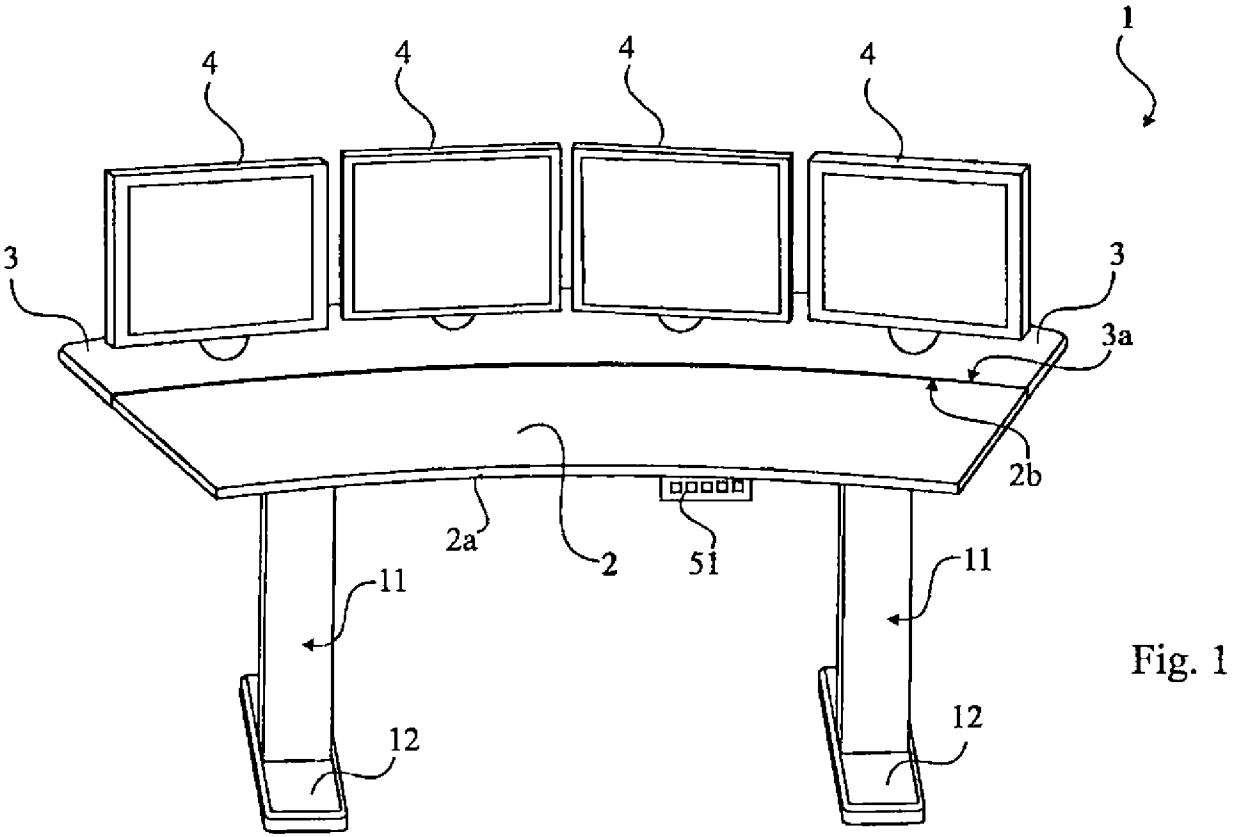
FIG. 1 shows an operator desk with a number of displays/monitors seen obliquely from the front.
Figure 6:
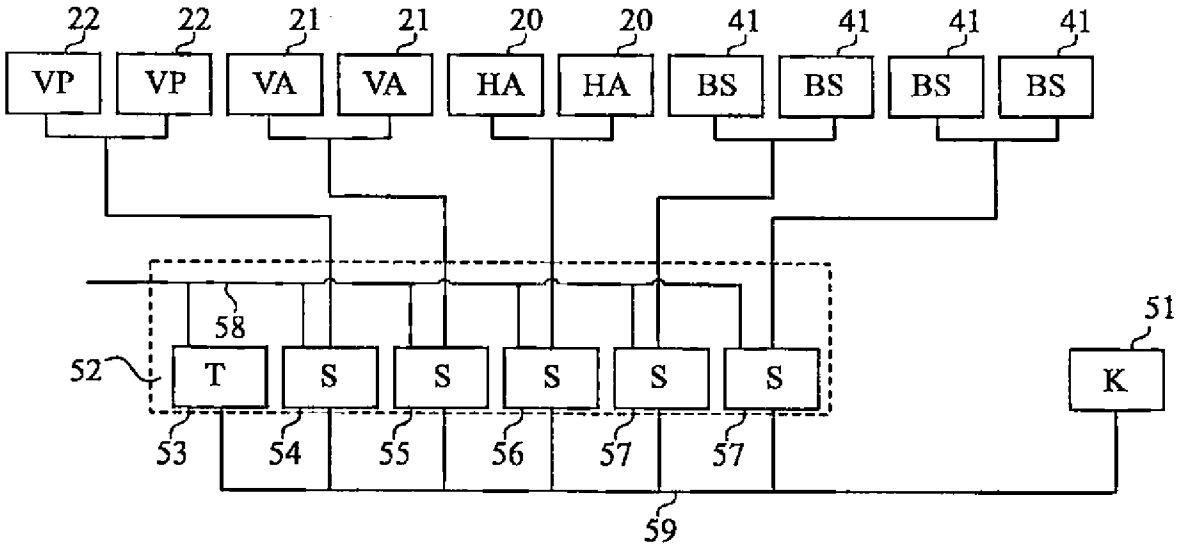
FIG. 6 shows a schematic outline of the control system.

FIG. 1 shows an operator desk 1 comprising a front work shelf 2, a rear shelf 3 intended for displays, below display shelf 3, and two vertical pillars 11 belonging to the pedestal 10, seen in FIG. 2, which carries the operator desk 1. In the example shown the operator desk 1 has a curved oblong shape, wherein the front work shelf 2 has a front concave first long side 2*a* and a rear convex second long side 2*b*, at which first long side 2*a* one or more operator/s will stand or sit. The rear display shelf 3 has a concave third long side 3*a* matching the second long side 2*b*. Four displays 4 are arranged on the rear display shelf 3. Further, there is shown a control panel 51 for giving input to the control system 50 of the desk, which is shown in FIG. 6.

The two vertical pillars 11 form legs of the operator desk 1. The respective vertical pillar 11 is telescopically extendable and has a base 12 in its lower end for meeting the floor and an attachment plate 13 in its upper end for attachment to the front work shelf 2. A first motorized actuator 22, not shown, but see the control system of FIG. 6, is provided in the respective pillar to make it possible to expand the vertical pillars 11 telescopically, which belongs to prior art and will therefore not be described more specifically. The telescopically extendable vertical pillars together with the first actuators, not shown, are the first vertically adjusting means 11, 22 of the operator desk. These means imply that the height of the front work shelf 2 may be adjusted.

The rear display shelf 3 is connected to the front work shelf 2 via two parallelly arranged horizontal arms 14, 15 having two corresponding vertical arms 16, 17. The respective horizontal arm comprises two parts, a front arm part 14 and a rear arm part 16, which are telescopically displaceable in relation to each other. In the respective horizontal arm 14, 15 a corresponding second motorized actuator 20 is arranged in the form of a adjusting means 20 for the horizontal arms—i.e. totally two adjusting means 20 for the horizontal arms, as there are two horizontal arms 14, 15—in order to be able to change the position of the front arm part 14 in relation to the rear arm part 15. The respective front arm part 14 is attached to the front work shelf 2 by an attachment plate 19. The respective rear arm part 15 is attached to the corresponding vertical arm 16, 17, in a lower arm part thereof. The telescopically extendable horizontal arm 14, 15 with the second motorized actuator 20 is the horizontally adjusting means 14, 15, 20 of the operator desk. The horizontally adjusting means 14, 15, 20 results in that the rear display shelf 3 may change its horizontal position in relation to the front work shelf 2, in a direction towards and away from the front work shelf 2, which implies that an operator may simply achieve an individually adapted distance to the displays 4.

The respective vertical arm 16, 17 comprises two parts, the lower arm part 16, and an upper arm part 17, which are telescopically displaceable in relation to each other. In the respective vertical arm 16, 17 a corresponding third motorized actuator 21 is provided in the form of adjusting means 21 for the vertical arms—i.e. totally two adjusting means 21 for the vertical arms, as there are two vertical arms 16, 17—to be able to change the position of the lower arm part 16 in relation to the upper arm part 17. The respective lower arm part 16 is attached to the corresponding rear arm part 15, and the respective upper arm part 17 has a free end 18, to which the rear display shelf 3 is intended to be attached. The telescopically extendable vertical arm 16, 17 with the third motorized actuator 1 is the second vertically adjusting means 16, 17, 21 of the operator desk 1. The second vertically adjusting means 16, 17, 21 result in that the rear display shelf 3 may change its vertical position in relation to the front work shelf 2, which implies that an operator easily may change the height of the displays 4.

Figure 3:
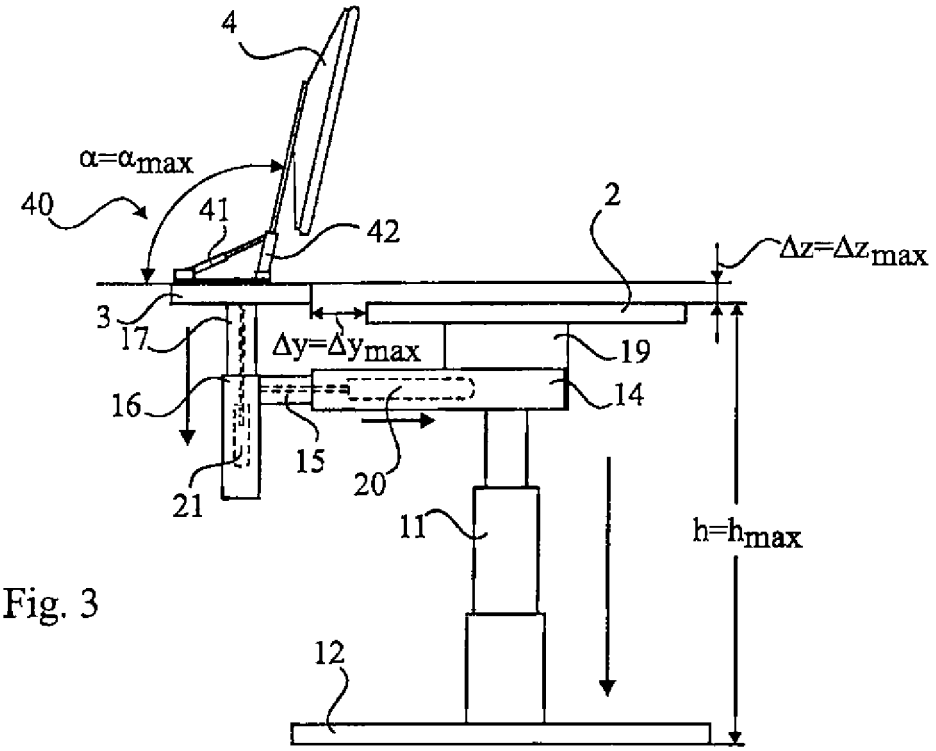
FIG. 3 is an explanatory sketch of the operator desk seen from the side, when all actuators are in maximally extended positions.

FIG. 3 shows the operator desk 1 in a position in which the respective vertical pillar 11, the horizontal arm 14, 15 and the vertical arm 16, 17 are in its maximal position, i.e. when they are telescopically entirely extended. In this position, the height h of the front work shelf 2 has reached its maximal height $h_{max}$. The rear display shelf 3 is at maximal distance from the rear work shelf 2 in the horizontal direction $\Delta y=\Delta y_{max}$ and maximally vertically above $\Delta z=\Delta z_{max}$. The respective display 4 is carried by a corresponding display stand 40. The respective display stand 40 comprises inclining means 41, 42 in the form of a fourth motorized actuator 41 arranged to influence a corresponding rocker 42, to which the corresponding display 3 is attached. The fourth motorized actuator 41 preferably is a motorized adjusting means, below designated display adjusting means 41. The respective display adjusting means 41 influences the corresponding rocker 42, so that the inclination a of the display 4 may be changed, which is here shown in its maximal position $\alpha=\alpha_{max}$.

Figure 4:
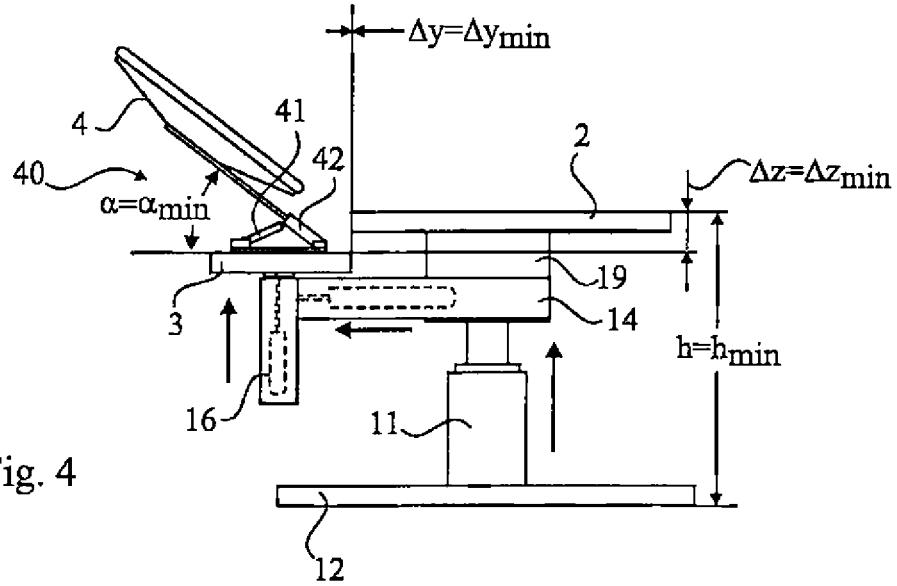
FIG. 4 is an explanatory sketch of the operator desk seen from the side, when all actuators are in maximally retracted positions.

FIG. 4 shows the operator desk 1 in a position in which the respective vertical pillar 11, the horizontal arm 14, 15 and the vertical arm 16, 17 are in its minimal position, i.e. when they are telescopically maximally retracted. In its lowermost end position the rear display shelf 2 is in the vertical direction $\Delta z$ somewhat below the rear work shelf 2, i.e. $\Delta z=0$. In the horizontal direction the rear display shelf 3 starts where the front work shelf 2 ends, i.e. $\Delta y=0$. From this position, the rear display shelf 2 may move horizontally away from the front work shelf 2 and vertically upwards from the front work shelf 2 towards the position shown in FIG. 3. Further, as the rear display shelf 3 is connected to the front work shelf 2, the rear display shelf 3 will move vertically when the front work shelf 2 is raised or lowered, i.e. the height of the rear display shelf 3 will be h+Δz. Of course, the respective telescopic arm/pillar 11, 14, 15, 16, 17 may take positions between the extreme positions.

Even if the lowermost vertical position $\Delta z_m i_n$ of the rear display shelf 3 in relation to the front work shelf 2 is shown in FIG. 3 to lie below the front work shelf 2, it is, of course, possible to arrange the lowermost position on level with the front work shelf 2 or above it. Equivalently, it is naturally possible to arrange the uppermost position $\Delta z_{max}$ of the display shelf 3 so that it lies below the front work shelf, on level with the work shelf 2 or as shown in FIG. 4 above the work shelf 2. In one example is Δzmin=−15 cm, i.e. 15 cm below the front work shelf 2, and $\Delta z_{max}$=+5 cm. In FIG. 3 the display is shown at its smallest angle of inclination $\alpha=\alpha_m i_n$, and in FIG. 4 in its maximal angle of inclination $\alpha=\alpha_{max}$. In one example the angle of inclination α may vary between 45° and 95°, but, of course, also other sizes of the angle of inclination α are quite possible.

Figure 5:
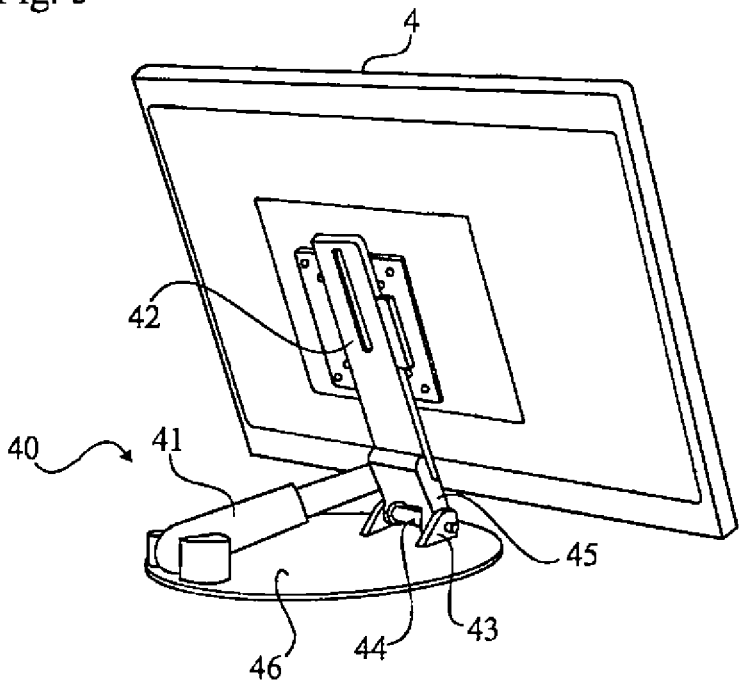
FIG. 5 shows a perspective view of a display seen obliquely from behind.

FIG. 5 shows a perspective view of a display 4 attached to a rocker 42, seen obliquely from behind. The rocker 42 is articulated in its lower end 45 by a hinge mounting 43, 44 on a base plate 46 intended to be mounted to the display shelf 3. The display adjusting means 41 are in one end pivotally attached to the base plate 46 and in the other end pivotally mounted to the rocker 42, at a level above the hinge mounting 43, 44. The inclination α of the respective display 4 may thereby be controlled by controlling the respective display adjusting means 41.

FIG. 6 shows a schematic outline of the control system. To control the adjusting means 20, 21, 22, 41 in the two vertical pillars 11, the two horizontal arms 14, 15, the two vertical arms 16, 17 and to the displays 4 a number of control units 54, 55, 56, 57 are used.

A control unit, e.g. an Unjo® control circuit, controls the current for two adjusting means simultaneously, i.e. a first control unit 54 controls a pair of adjusting means 22 in the vertical pillars 11, a second control unit 55 controls the horizontal arm adjusting means 20 for the horizontal arms, a third control unit 56 controls the vertical arm adjusting means 21 in the vertical arms 16, 17, and a fourth and a fifth control unit 57 controls a fourth and a fifth pair of display adjusting means 41 for two pairs of displays 4. Each adjusting means 20, 21, 22, 41 are provided with transmitters for measurement of position and speed, which in the corresponding control unit 54, 55, 56, 57 is used to synchronize the motion for each pair of adjusting means 20, 21, 22, 41. The maximal current of the motors is limited to protect the control units and their motors.

The control units 54, 55, 56, 57 of the system are connected via a first communication link 58, e.g. according to RS-485. Via the communication link 58, an order of motion take place as well as a report of the present position and of other status information is sent. One of the control units 54, 55, 56, 57 is a communication master, for instance the first control unit 54 is a communication master while all other control units 55, 56, 57 are communication slaves. Thus, the communication master 54 is the minimal complement of the system 50; arbitrary combination of the other control units 55, 56, 57 with associated pairs of adjusting means 21, 20, 41 may then be added up to maximal complement. The communication master 54 is also responsible for the synchronization between the different motions of the operator desk 1, possible limitations of the motions and for identification of which other units of the system 50 are connected when the operator desk 1 is provided with voltage. A control panel 51 communicates with the control units 54, 55, 56, 57 via a second communication link 59, for example according to RS232. The control panel 51 can also be replaced by a computer. A transformer 53 supplies current to the system 50. The transformer 53 and the control units 54, 55, 56, 57 are arranged in a control box 52, which may for instance be mounted under the desk.

The motors of the adjusting means 20, 21, 22, 41 are current controlled, wherein maximal momentary current is limited. The limitation also varies during time in order to permit high momentary currents at the same time as overload of the motors (through heating) is prevented. The current control implies continuous linear adjustment of the moment of the motors. Through feedback from the pulse transmitter, not shown, on the motor axes of the motors, the speed and position of the motors are further continuously adjusted.

Each control unit 54, 55, 56, 57 is provided with an initiation entrance and initiation exit as well as an entrance defining the unit as a communication master 54, and a communication slave 55, 56, 57, respectively. In a passive position the initiation exit is in an inactive position. The control units 54, 55, 56, 57 of the system 50 are connected in an initiation chain, wherein a initiation exit of one unit is connected with the initiation entrance of the next unit (daisy-chain). The communication master 54 always is the first unit, and then the initiation entrance is ignored. When the system 50 is initiated, the communication master 54 puts its initiation exit active, wherein the next unit 55, 56, 57 is put into an addressing position. The communication master 54 allocates the unit 55, 56, 57 a communication address, wherein the units 55, 56, 57 change to an addressed position, which activates the initiation exit of the unit 55, 56, 57. The process is repeated with the subsequent units 55, 56, 57 until all control units 55, 56, 57 are addressed.

The communication of the system 50 is then entirely activated, and each control unit 55, 56, 57 is identified according to its position in the cabling of the system. This implies that at a replacement of a control unit 55, 56, 57, the new control unit 55, 56, 57 will get the same system function without programming or parameter settings.

Each control unit 54, 55, 56, 57 drives a pair of adjusting means 22, 21, 20, 41, wherein the synchronization within the pair takes place internally in the control unit 54, 55, 56, 57. The positions of the adjusting means 22, 21, 20, 41 are then coordinated so that the maximal deviation at normal operation never exceeds some single number of steps of the pulse transmitter. At extreme situations, for instance if one adjusting means is stopped by an inelastic outer hindrance, the deviation will not exceed some ten steps of the pulse transmitter. The deviation is also known, and therefore a correct synchronization is automatically regained when a normal operation is resumed.

Normally, no motion synchronization is performed between the pair of adjusting means 22, 21, 20 which control the motions (h, Δz, Δy) of the desk 1. However, the control units 57 of the displays may synchronize the pair of adjusting means 41 of the displays with each other, so that, if one wants to change the angle α of inclination for all displays, this may be performed with synchronization. Preferably, the motions in relation to each other are pre-adjusted, so that a movement of the work shelf 3 upwards (h) prevents all other motions (Δz, Δy, α) in order to minimize the size of the transformer 53. In one embodiment, the control units 54, 55, 56, 57 may be programmed such that forbidden areas may be initiated, which for instance may imply that maximal desk height $h_{max}$ of the work shelf 2 and maximal height $\Delta z_{max}$ of the display cannot be achieved simultaneously because of a mechanical hindrance above the displays 4.

At start of voltage supply the position of the adjusting means 20, 21, 22, 41 is unknown, and therefore an initiation motion towards a detectable position (home position) is made. The initiation motion may be performed at a reduced speed and a reduced moment. The home position is suitably arranged as a digital position transmitter, (micro switch, inductive transmitter, optic transmitter or the like), not shown in the figures, for each adjusting means 20, 21, 22, 41 with the output signal in the one position, when the position is between the first end position and the home position while the output signal is in the other position within the balance of the motion area. Minimal initiation motion is obtained when the home position is placed in a position with the smallest average distances to the positions which are statistically most common at operation of the operator desk 1.

When the digital position transmitter has indicated a change, the position measurement is absolutely defined. The permitted motion area is defined by adjustable parameters stored in the control unit 54, 55, 56, 57. A pair of adjusting means 20, 21, 22, 41 which for some reason has been put out of the synchronized position will at the initiation be treated in two different ways depending on the signals from the digital position transmitters:

If for a pair of adjusting means 20, 21, 22, 41 both digital position transmitters give the same output signals, the adjusting means 20, 21, 22, 41 are first moved with a maintained synchronization error. When the first adjusting means reaches the home position it will be stopped, while the second adjusting means continues to its home position, wherein the motion is also synchronized.

If the digital position transmitters give different output signals, the respective adjusting means of the pair of adjusting means 20, 21, 22, 41 will be moved in different directions and stopped when the respective home position is reached, wherein the synchronization error is continuously reduced until synchronization is achieved.

Figure 7:
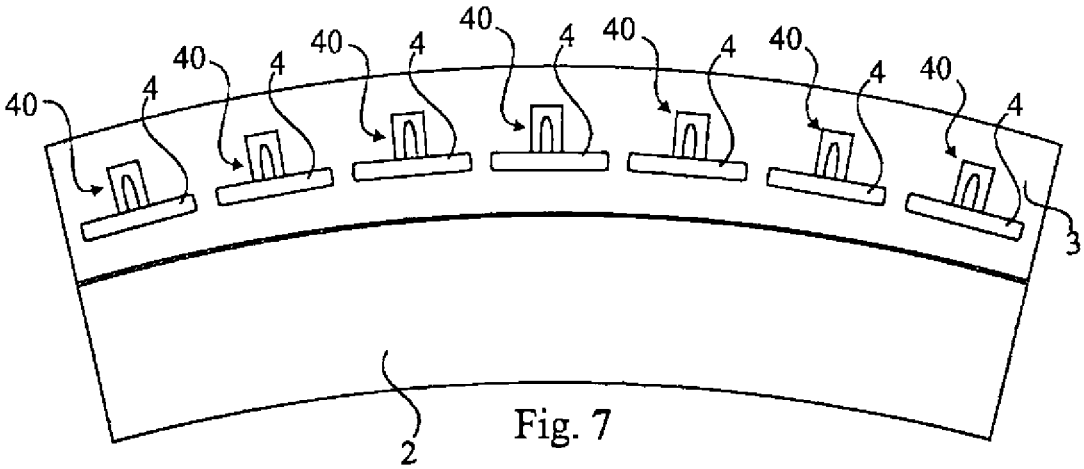
FIGS. 7 and 8 show an operator desk seen from above.
Figure 8:
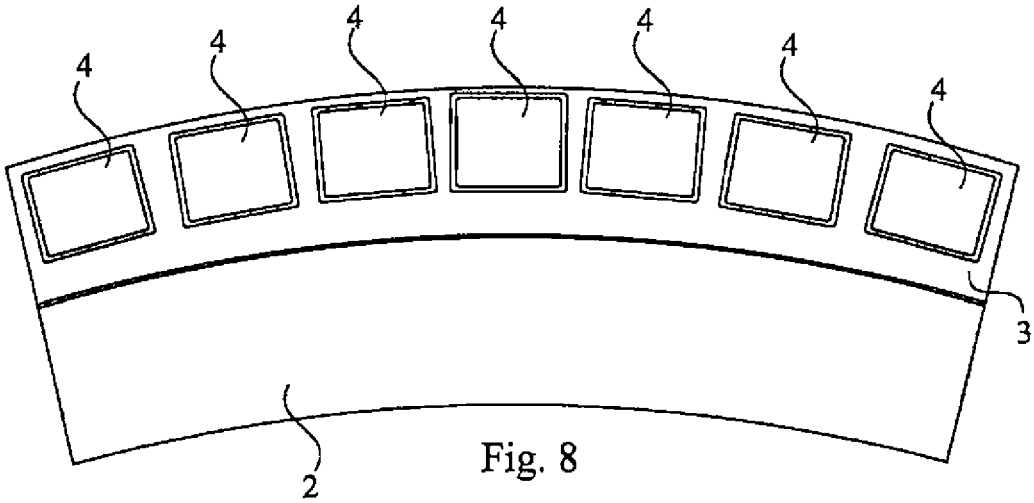

FIGS. 7 and 8 show an operator desk seen obliquely from above with six displays 4. In FIG. 7 the displays 7 are upright as in FIG. 3, and in FIG. 8 the displays are inclined backwards as the display 5 in FIG. 4. From the position in FIG. 7 the displays 4 may change their angles of inclination to the position of FIG. 8 in a synchronized motion thanks to the control system 50. Further, it is understood that this may be achieved despite the displays 4 are not aligned but stand at a concave line.

The invention has above been described according to its preferred embodiment. However, it should be understood that the invention is not limited only to this embodiment but may be varied within the scope defined by the claims.

For instance, it is conceived:

that the vertical pillars 11 are not telescopically extendable;

that the operator desk consist of one desk shelf 2, 3 and that the displays 4 hence cannot be adjusted forwards and backwards;

that the rear display shelf 3 may be vertically changed but not forwards and backwards;

that the rear display shelf 3 may be changed forwards and backwards but not vertically;

that the display stands 40 are not arranged on a flat display shelf 3 but on any structure which may give support to the display stands 40;

that the display stands 40 lack motorized inclining means 41, 42;

that the operator desk 1 may be used as a writing table;

that the displays 4 include all kinds of displays;

that the number of displays 4 may be one or more;

that the operator desk 1 may be used without displays 4.

What is claimed is:

1. An operator desk system comprising:

an operator desk;

at least two display/monitor stands arranged on an operator desk in order to carry one display/monitor each, characterised in that each display stand comprises individual motorized inclining means, said inclining means being arranged to change the inclination of the corresponding display stand in a synchronized motion in relation to each other, independent of the location of said displays on the operator desk.

2. The operator desk according to claim 1, characterised in that the operator desk system comprises synchronization means for performing said synchronization of the inclining means, so that they may change the inclination of the displays in a synchronized motion.

3. The operator desk system according to claim 1, characterised in that the inclining means comprise a motorized actuator arranged to influence the inclination on an articulated rocker on which the display is mounted.

4. The operator desk system according to claim 1, characterised in that the number of display stands and displays are at least three, and that they are arranged along a concave line so that the displays face a central point.

5. The operator desk system according to claim 1, characterised in that the operator desk comprises:

a front work shelf intended as a work surface for one or more operators, said work shelf having an oblong extension with a front long side and a rear long side;

a rear support structure including the display stands for carrying the displays, said rear support structure being arranged behind the work shelf, so that an operator placed at the front long side of the work shelf has the work shelf between himself and the rear support structure; and a pedestal carrying the work shelf and the support structure from a ground.

6. The operator desk system according to claim 5, characterised in that the pedestal comprises motorized horizontally adjusting means to adjust the position of the support structure horizontally in a direction towards and away from the work shelf.

7. The operator desk system according to claim 6, characterised in that the horizontally adjusting means of the pedestal comprises at least one telescopically extendable horizontal arm, which extends transversally out from the rear long side of the work shelf, and at least one corresponding motorized actuator arranged to change the length of the horizontal arm, so that the support structure may adjust its position horizontally in a direction towards and away from the work shelf, and in that the pedestal comprises a vertically adjusting means to adjust the height of the support structure in relation to the work shelf and wherein said vertically adjusting means comprises at least one telescopically extendable vertical arm arranged to adjust the height of the support structure, said vertical arm being mounted on a rear end of the horizontal arm, and at least one corresponding motorized actuator arranged to change the length of the vertical arm.

8. The operator desk system according to claim 5, characterised in that the pedestal comprises motorized first vertically adjusting means to vertically adjust the height of at least the front desk shelf.

9. The operator desk system according to claim 5, characterised in that the pedestal comprises vertically adjusting means to adjust the height of the support structure in relation to the work shelf.

10. The operator desk system according to claim 5, characterised in that the support structure is a rear flat shelf, on which the display stands are arranged.

11. The operator desk system according to claim 1, characterised in that it comprises a control system including at least one control unit to control a motorized means with the operator desk and one control panel to give input to the control unit.

12. A motorized operator desk comprising:

a front work shelf intended as a work surface for one or more operators, said work shelf having an oblong extension with a front long side and a rear long side;

a rear support structure intended to carry a display/monitor, said support structure being arranged behind the work shelf, so that an operator being at the front long side of the work shelf has the work shelf between himself and the rear support structure; and a pedestal carrying the work shelf and the support structure from a ground;

characterised in that the pedestal comprises motorized horizontally adjusting means to adjust the position of the support structure horizontally in a direction towards and away from the work shelf;

in that the horizontally adjusting means of the pedestal comprises at least one telescopically extendable horizontal arm, which extends transversally out from the rear long side of the work shelf, and at least one corresponding motorized actuator arranged to change the length of the horizontal arm, so that the support structure may adjust its position horizontally in a direction towards and away from the work shelf; and in that the pedestal comprises a vertically adjusting means to adjust the height of the support structure in relation to the work shelf and wherein said vertically adjusting means comprises at least one telescopically extendable vertical arm arranged to adjust the height of the support structure, said vertical arm being mounted on a rear end of the horizontal arm, and at least one corresponding motorized actuator arranged to change the length of the vertical arm.

13. The motorized operator desk according to claim 12, characterised in that the pedestal comprises motorized vertically adjusting means to vertically adjust the height of at least the front desk shelf.

14. The motorized operator desk according to claim 13, characterised in that the vertically adjusting means to vertically adjust the height of at least the front desk shelf include at least one telescopically extendable vertical pillar carrying the work shelf, and at least one corresponding motorized actuator arranged to change the length of the pillar.

15. The motorized operator desk according to claim 14, wherein the vertically adjusting means to vertically adjust the height of at least the front desk shelf comprises two telescopically extendable vertical pillars arranged at a predetermined distance from each other and at a predetermined distance from one short side each of the work shelf, each one with a motorized actuator.

16. The motorized operator desk according to claim 12, characterised in that the support structure includes at least two display stands with at least two corresponding displays, each of said display stands comprising motorized inclining means to adjust the inclination of the corresponding display.

17. The motorized operator desk according to claim 16, characterised in that the inclining means comprise a motorized actuator arranged to influence the inclination of an articulated rocker on which the display is mounted.

18. The motorized operator desk according to claim 16, characterised in that the number of display stands and displays are at least three, and that they are arranged along a concave line so that the displays face a central point.

19. The motorized operator desk according to claim 12, characterised in that the support structure includes a rear flat display shelf.

20. The motorized operator desk according to claim 19, characterised in that the work shelf has an oblong curved shape, wherein the front long side of the work shelf is concave and the rear long side of the work shelf is convex, and that the display shelf also has an oblong curved shape, wherein its concave long side meets the convex rear long side of the work shelf.

21. The motorized operator desk according to claim 12, characterised in that it comprises a control system including at least one control unit to control the motorized means with the operator desk and one control panel to give input to the control unit.

* * * * *